US007159365B2

(12) United States Patent
Cohen

(10) Patent No.: US 7,159,365 B2
(45) Date of Patent: Jan. 9, 2007

(54) SYSTEM FOR MAKING WALLS

(76) Inventor: Jerome A. Cohen, 279 Fairbrook Dr., Henderson, NV (US) 89074

( * ) Notice: Subject to any disclaimer, the term of this patent is extended or adjusted under 35 U.S.C. 154(b) by 89 days.

(21) Appl. No.: 10/643,447

(22) Filed: Aug. 19, 2003

(65) Prior Publication Data

US 2004/0139672 A1 Jul. 22, 2004

Related U.S. Application Data

(60) Provisional application No. 60/404,631, filed on Aug. 19, 2002.

(51) Int. Cl.
*E04B 1/32* (2006.01)

(52) U.S. Cl. ..... 52/245; 52/108; 52/241; 52/293.3; 52/481.1; 52/633; 52/636; 52/637; 52/639; 52/745.05; 52/745.09; 52/745.11; 52/745.14; 52/85

(58) Field of Classification Search ..... 52/108, 52/241, 245, 293.3, 481.1, 483.1, 745.1, 52/745.05, 745.09, 745.11, 745.13, 745.14, 52/633, 634, 636, 637, 639, 247, 85, 86
See application file for complete search history.

(56) References Cited

U.S. PATENT DOCUMENTS 1,168,909 A * 1/1916 Rook, Jr. ..... 138/115
1,963,416 A * 6/1934 Minshall ..... 52/735.1
2,419,321 A * 4/1947 Lopes ..... 198/853
2,737,266 A * 3/1956 Gross ..... 52/483.1
3,011,228 A * 12/1961 Driggs ..... 52/282.4
4,566,141 A * 1/1986 Mahoney ..... 4/506
4,679,763 A * 7/1987 Brotherton ..... 29/446
4,805,364 A * 2/1989 Smolik ..... 52/241
5,155,872 A * 10/1992 Aymes ..... 4/506
5,291,717 A * 3/1994 Turner ..... 52/745.07
5,875,500 A * 3/1999 Shaanan et al. ..... 4/506
6,000,181 A * 12/1999 Wheeler ..... 52/241
6,094,877 A * 8/2000 White ..... 52/247
6,115,984 A * 9/2000 Paradis ..... 52/717.03
6,237,301 B1 * 5/2001 Paradis ..... 52/717.03
6,612,087 B1 * 9/2003 diGirolamo et al. ..... 52/712
6,625,942 B1 * 9/2003 Wheeler ..... 52/241
6,637,173 B1 * 10/2003 Wheeler ..... 52/745.12
6,655,100 B1 * 12/2003 Andino ..... 52/247

* cited by examiner

*Primary Examiner*—Jeanette E. Chapman
(74) *Attorney, Agent, or Firm*—Michaud-Duffy Group LLP

(57) ABSTRACT

In a system for making walls, at least two pairs of connector plates are provided, each including receptacle for receiving an end of a structural member. At least one spacer plate is located between and rotatably coupled to successively positioned connector plates. To form a wall, a pair of connector plates is coupled via the retaining means, one to each of a pair of generally opposing ends defined by structural members. The connector plates are rotatably movable relative to the spacer plates thereby allowing the structural members to be oriented relative to one another so as to form a surface having desired contours.

13 Claims, 6 Drawing Sheets

10
12
18
20
20
12
18
18
18
18
18
16
16
14
12
16
14
14
16
12
38

SYSTEM FOR MAKING WALLS

CROSS-REFERENCE TO RELATED APPLICATIONS

This application is entitled to the benefit of and incorporates by reference essential subject matter disclosed in Provisional Patent Application No. 60/404,631 filed on Aug. 19, 2002.

FIELD OF THE INVENTION

The present invention is generally related to the construction of walls, and is more particularly directed to a combination of components whereby wells having complex contours can be easily constructed.

BACKGROUND OF THE INVENTION

In general, buildings, as well as exterior and interior walls, are constructed using linear, e.g. substantially straight, materials. For example, framing lumber and steel studs and beams are typically supplied in a rectilinear configuration. When building walls, these materials are usually set at right angles to one another to form square or rectangular interior spaces. A difficulty occurs when a builder, homeowner, or architect wishes to incorporate curved walls into a structure.

Walls are most often constructed by attaching a base plate or shoe and one or two plates to a number of studs usually spaced 16 to 24 inches apart. These standard walls are usually built on a floor in a prone position and then "stood up" into place. Historically, this has not been the situation where curved walls are desired.

In the past, curved walls were built in place on a curved, custom cut, base plate. If, for example, a curved wall was to be made using 2 inch by 4 inch material a large number of consecutive cuts had to be made in the base and top plates in order to allow the material to be bent into an arc. This can be extremely tedious and time consuming and results in pieces of material with little to no structural integrity. In addition, since most of the material is lost to the cuts that must be made, attachment to studs or wall board is difficult if not impossible. Accordingly, the walls must be sheathed in a material with sufficient strength and rigidity to compensate for that loss in the base and top plates. Usually this requires the use of plywood or like material. Depending on the size and radius of the curve several sheets of plywood may be required. This causes a great deal of waste to be generated.

Another difficulty sometimes occurs regarding the building of straight walls. It can be difficult, particularly when remodeling existing structures to frame a wall and have it fit exactly between two existing walls. This is due in part to the fact that existing walls are rarely straight. In addition, human error can also be an issue. Accordingly, there is presently a need for a manner by which one can adjust the length of a wall once it is built so that precise fits between existing walls can be accomplished.

Based on the foregoing, it is the general object of the present invention to overcome or improve upon the problems and drawbacks of the prior art.

SUMMARY OF THE INVENTION

The present invention resides in one aspect in a system for making walls that includes at least two pairs of connector plates each incorporating means for receiving an end of a structural member, such as, but not limited to wooden or metal studs. At least two spacer plates are also provided so that during the construction of a wall successively positioned connector plates can be rotatably coupled to one another by at least one of said spacer plates.

To form a wall, a pair of connector plates is coupled via the retaining means, one to each of a pair of generally opposing ends defined by each structural member. The connector plates being rotatably movable relative to the spacer plates thereby allowing the structural members to be oriented relative to one another so as to form an arcuate surface when a wall-forming material is fastened to, and extends between the structural members.

Preferably, each of the spacer plates defines adjustment means for selectively increasing or decreasing the distance between successive stud connector plates. In the preferred embodiment of the present invention, the adjustment means takes the form of at least one elongated slot extending through the spacer plates. A fastener extends through one of the connector plates in each of the at least two pairs of connector plates and a portion of the fastener is slidably and rotatably positioned in the elongated slot. In this manner, the spacer plate and the connector plate are movable relative to one another, rotatably, and along the slot to allow the distance between, and the relative orientation of successive connector plates to be desirably configured. If greater adjustability is required, a pair of spacer plates can be interposed between each of the connector plates with the slots defined by each connector plate slidably cooperating with one another.

A pair of structural straps can also be provided each extending between, engaging and being coupled to an outer surface defined by each of the connector plates. Preferably, one of the structural straps is positioned adjacent to, and extends approximately perpendicular to, one distal end defined by the structural members, and the other of the structural straps is positioned adjacent to, and extends approximately perpendicular to, a generally opposing distal end defined by the structural members.

In the preferred embodiment of the present invention, a second pair of structural straps is provided each positioned adjacent to, and extending approximately perpendicular to, one distal end defined by the structural members. Each of the second pair of structural straps being positioned approximately opposite a corresponding structural strap from the first pair.

An advantage of the present invention is that walls having complex contours can be easily, quickly and economically fabricated.

Another advantage of the present invention is that the overall length defined by a wall can be adjusted to exactly fit between, and mate to, existing walls.

DETAILED DESCRIPTION OF THE PREFERRED EMBODIMENTS

Figure 1:
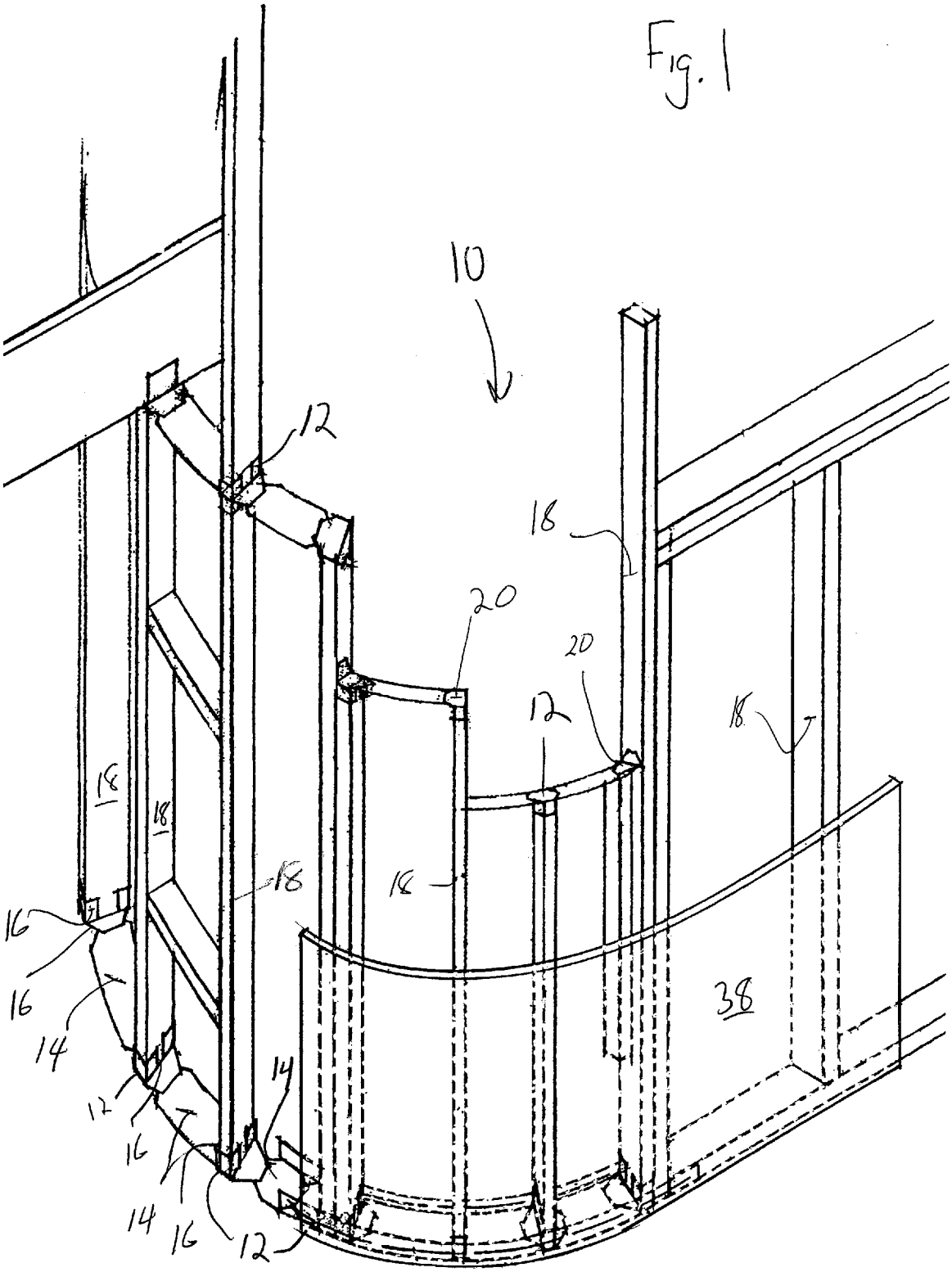
FIG. 1 is a partial perspective view of a wall built using the system of the present invention, the wall is shown having a single piece of sheet type material attached thereto.
Figures 2, 3, 4:
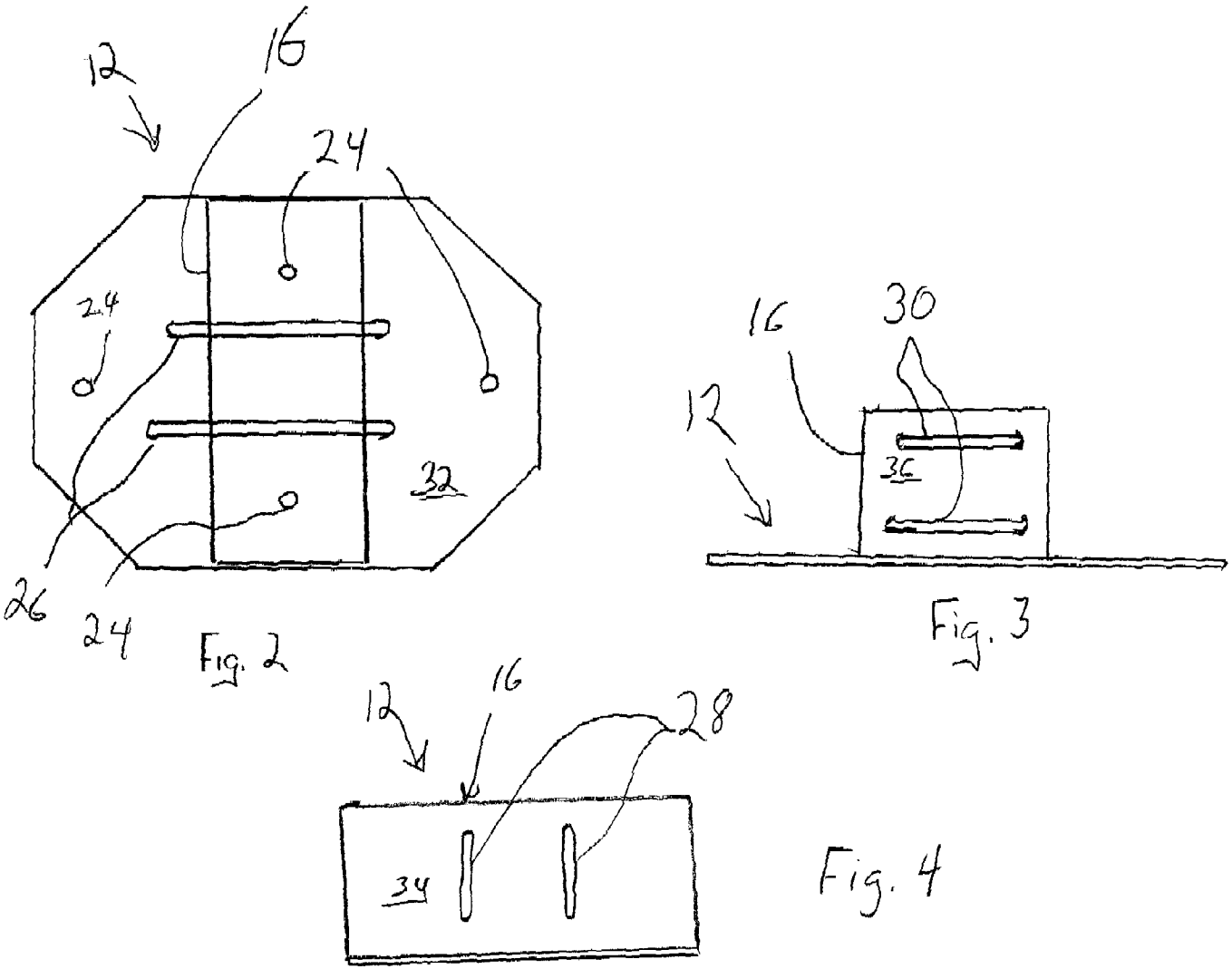
FIG. 2 is a plan view of a connector plate.
FIG. 3 is a front elevation of the connector plate of FIG. 2.
FIG. 4 is a side elevational view of the connector plate of FIG. 2.
Figure 10:
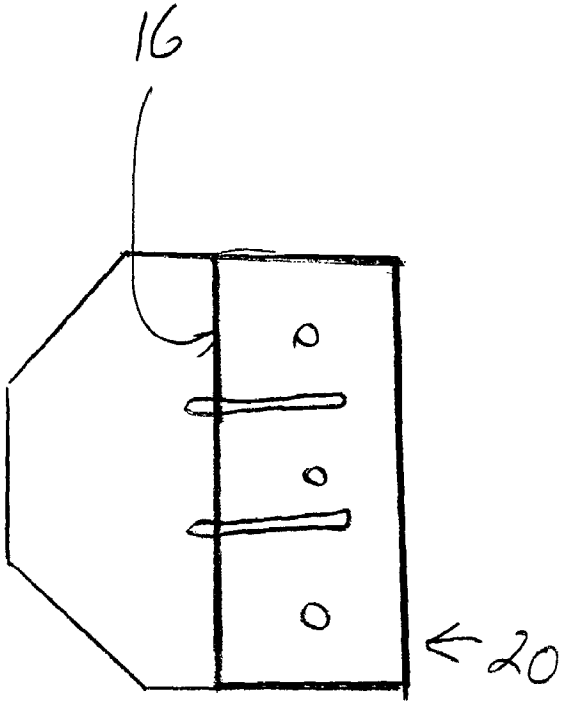
FIG. 10 is a plan view of an end connector of the present invention.

As shown in FIG. 1 a curved wall made in accordance with the present invention is generally designated by the reference number 10 and includes a plurality of connector plates 12. A spacer plate 14 is interposed between and rotatably coupled to successive connector plates 12. Referring to FIGS. 1–4, each connector plate 12 defines a receptacle portion 16 for receiving a structural member 18, such as, but not limited to a wooden or metal stud. In the embodiment illustrated in FIG. 1, a connector plate 12 is attached to opposing distal ends of a portion of the structural members. Where a structural member 18 abuts another wall or a longer structural member, an end connector 20, as shown in FIG. 10 is attached to the structural member to provide a flush fit. The connector plates 12, spacer plates 14 and end connectors 20 are each made from a suitable material, such as, but not limited to metal, plastic, or a fiber reinforced composite material, however, the present invention is not limited in this regard.

Figure 9:
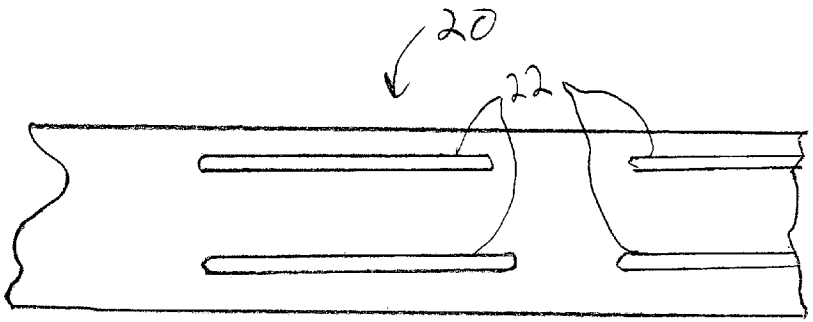
FIG. 9 is a partial view of a structural strap used in the system for making walls of the present invention.

As shown in FIGS. 1 and 9, structural straps 21 are attached to the structural members 18 via fasteners (not shown) at a lower distal end and extend in a direction approximately perpendicular to the structural members. The structural straps 21 are positioned generally opposite one another and provide stability to the wall during construction. While an upstanding wall has been shown and described, the present invention is not limited in this regard as horizontal surfaces or other curved horizontal surfaces having complex contours can also be fabricated using the system of the present invention without departing from the broader aspects thereof. Furthermore, while structural straps 21 have been shown only being positioned at a lower portion of a wall, the present invention is not limited in this regard as the structural straps 21 can, and preferably are also positioned at an upper portion of the wall.

To fabricate a wall employing the present invention the wall can be framed while lying on a horizontal with the structural straps 21 fastened in place. Note that in the illustrated embodiment, the structural straps 21 define slots 22 extending therethrough. The slots 22 allow relative motion between the structural members coupled to the connector plates 12 and the structural straps 21. The relative motion allows the wall 10 to be manipulated to conform to a desired shape. The wall 10, once in an upstanding position can be fastened to a floor and/or ceiling by fasteners (not shown) that extend through apertures 24 defined by the connector plates. Likewise, the connector plates 12 can be attached via fasteners (not shown) that extend through connector plates via slots 26, 28, and 30 defined by a bottom, side and front surface 32, 34, and 36 respectively, defined by the connector plates.

Figure 6:
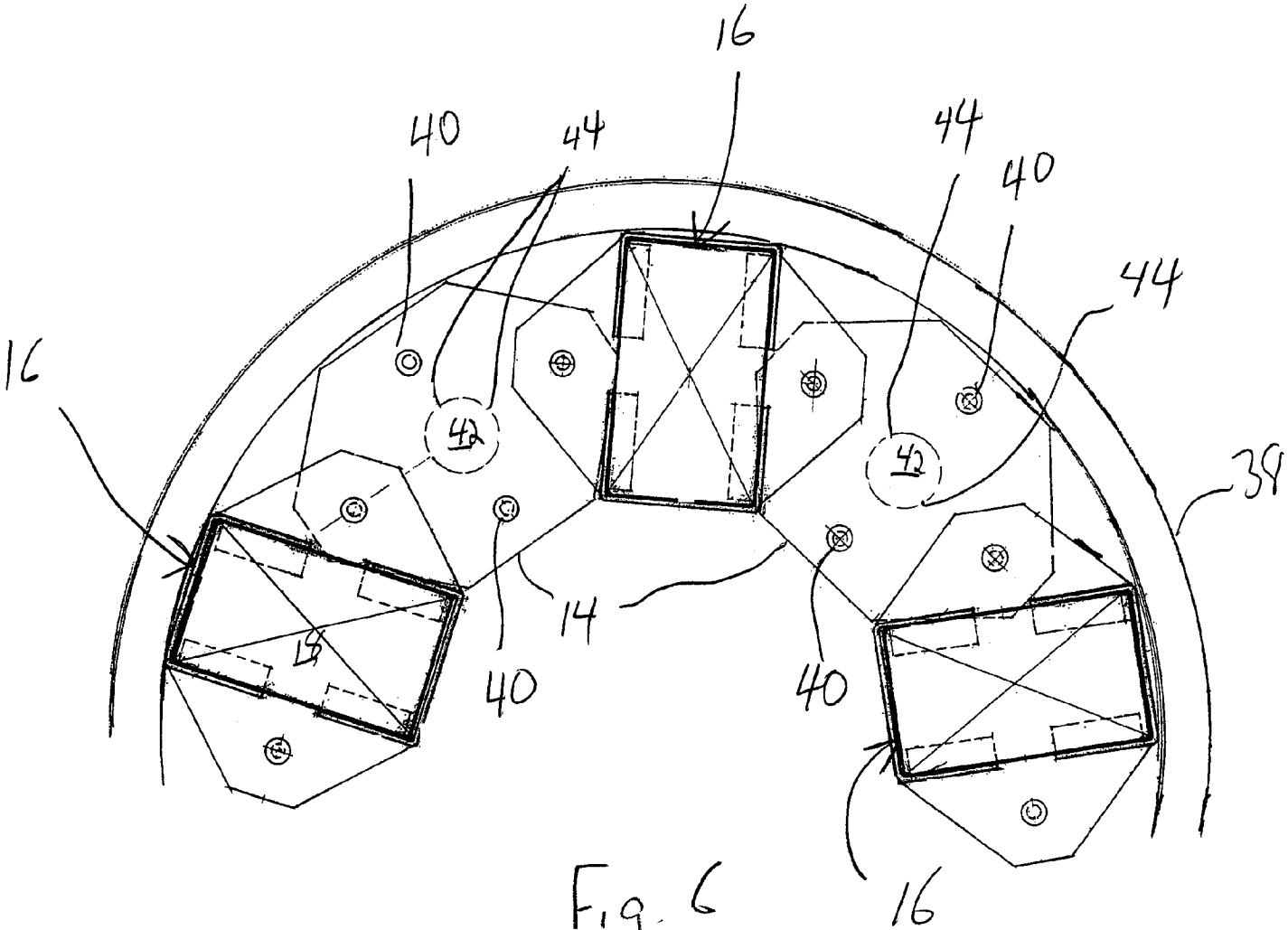
FIG. 6 is a cross sectional plan view of a curved wall fabricated in accordance with an embodiment of the present invention.
Figure 7:
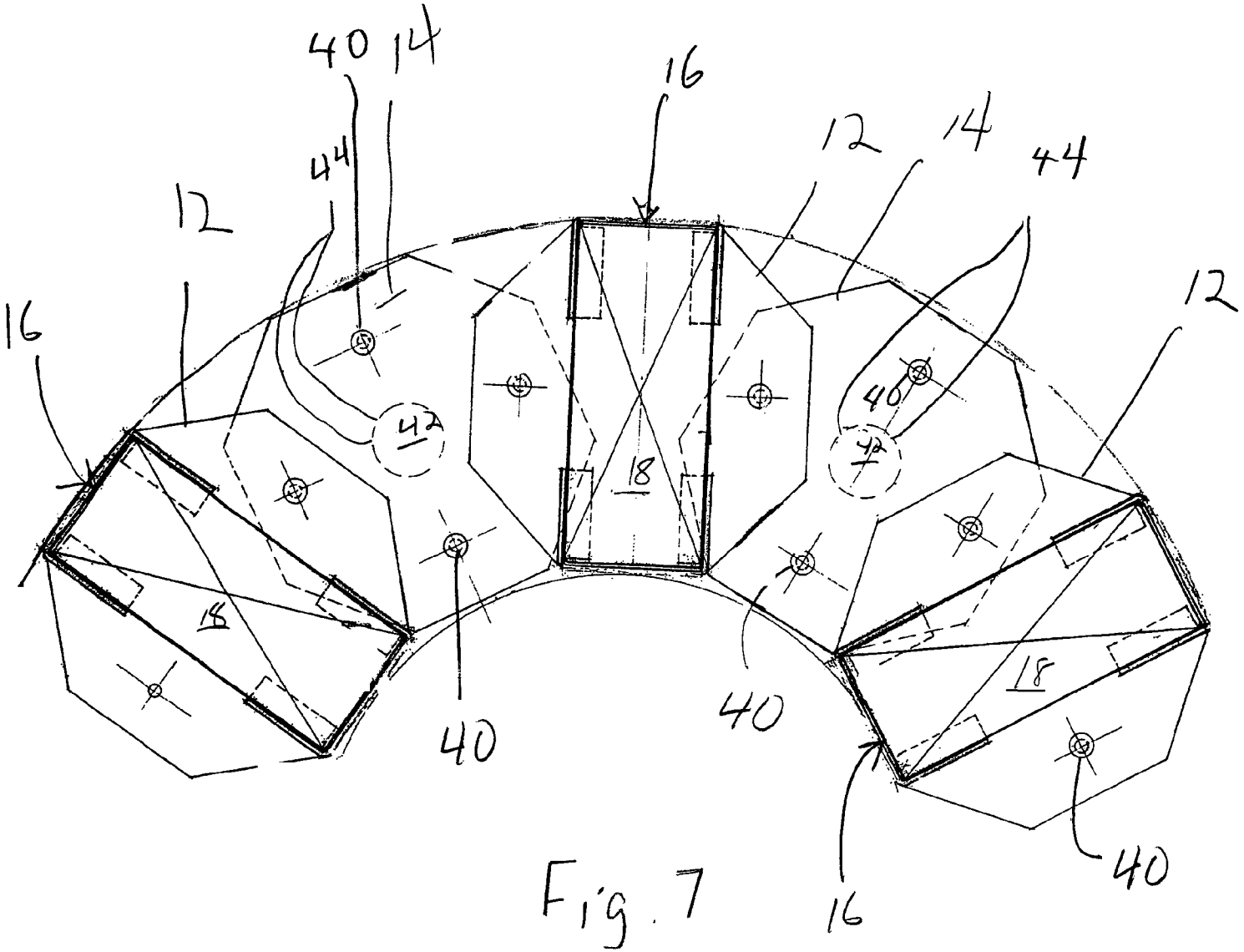
FIG. 7 is a cross sectional plan view of a curved wall fabricated in accordance with an embodiment of the present invention.

As shown in FIGS. 1 and 6, wall board 38, or other sheet-type wall covering known to those skilled in the pertinent art to which the present invention pertains, can be attached to the wall. FIGS. 6 and 7 illustrate tight radiused curves, FIG. 7 illustrates the same configuration as in FIG. 6 but employing larger structural members 18. The spacer plates 14 shown in the illustrated embodiments each define apertures 40 to allow for the passage of fasteners (not shown) there through to secure the wall 10 to a floor or ceiling. In addition, the spacer plates 14 each defines knock-out portions 42 retained in the spacer plate by frangible nicks 44. If desired the knock out portions 42 can be removed from the spacer plates to allow conduits, wires, or the like to pass therethrough. While a single spacer plate 14 positioned between successive connector plates 12 has been shown and described, the present invention is not limited in this regard as two or more spacer plates can be attached to one another and positioned between successive connector plates to allow one to achieve a desired contour or distance between structural members.

Figure 5:
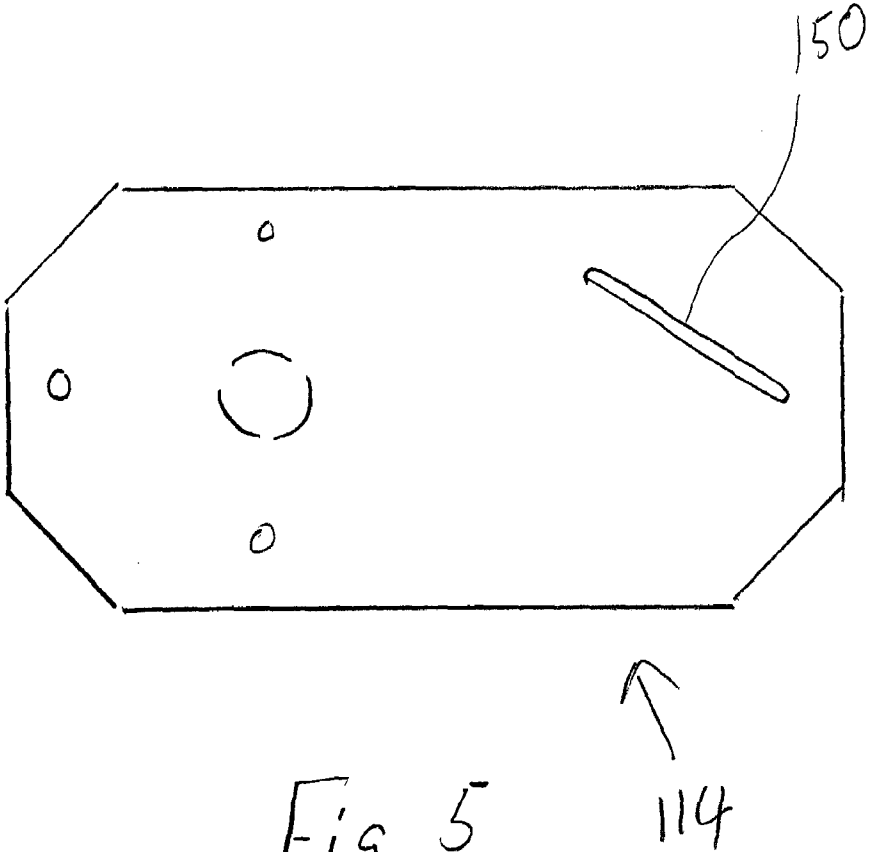
FIG. 5 is a plan view of an embodiment of a spacer plate of the present invention.
Figure 8:
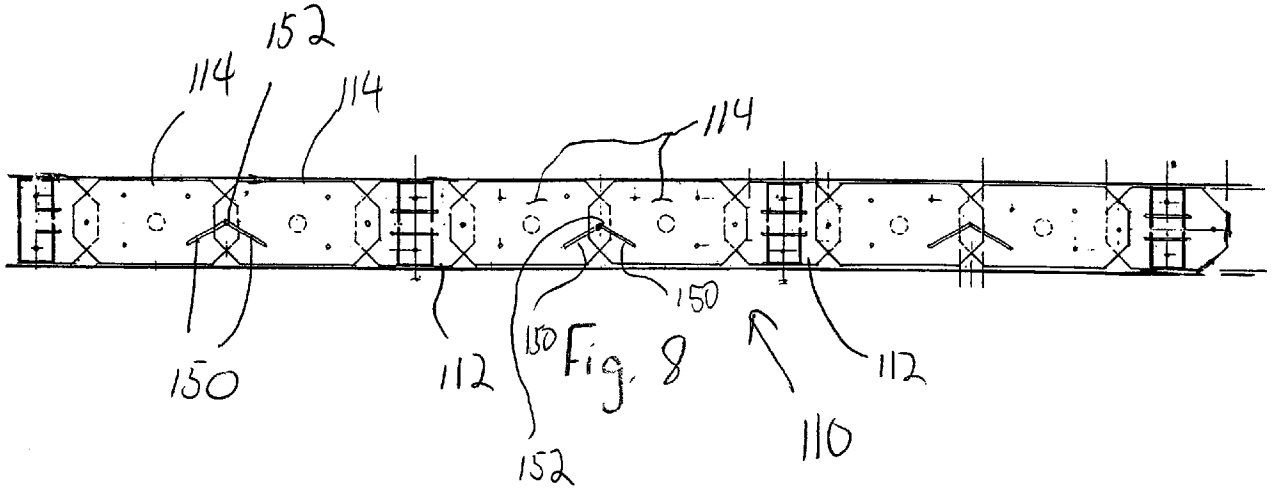
FIG. 8 is a plan view of a portion of an embodiment of the system for making walls of the present invention.

A second embodiment of the system for making walls of the present invention, shown in FIGS. 5 and 8, is generally designated by the reference numeral 110. The system 110 is similar in many respects to the system 10 described above, and therefore like reference numerals preceded by the number 1 are used to indicate like elements. The system 110 differs from the system 10 in that a pair of spacer plates 114 is positioned between successive connector plates 112. As best seen in FIG. 5, the spacer plate 114 defines an angled slot 150 extending there through. Referring back to FIG. 8, consecutively positioned spacer plates 114 are oriented such that the slot 150 in one of the spacer plates, overlaps the slot 150 in the adjacent spacer plate. A fastener 152, such as, but not limited to, a pin, rivet, or a nut and bolt combination extends through the two adjacent spacer plates 114 slidably and rotatably coupling them together. While a spacer plate incorporating a single slot has been shown and described, the present invention is not limited in this regard as a pair of generally opposed slots 150, not shown, can also be employed with one of the slots being slidably and rotatably coupled to a connector plate 112 via a fastener (not shown). Moreover, any number of spacer plates 114 can be attached to one another to enable one to form a desired arcuate shape, or establish a desired spacing between consecutive structural members. During use of the above-described system, complex arcuate contours can be readily created, or straight walls created, and lengthened or shortened as desired.

While preferred embodiments have been shown and described, various modifications and substitutions may be made without departing from the spirit and scope of the present invention. Accordingly, it is to be understood that the present invention has been described by way of example, and not by limitation.

What is claimed is:

1. A system for making walls comprising:

at least two pairs of connector plates each including retaining means for receiving an end of a structural member;

at least two spacer plates, each defining at least one elongated slot extending through said spacer plate;

a fastener extending through one of said connector plates in each of said at least two pairs of connector plates, a portion of said fastener being slidably and rotatably positioned in said elongated slot so that said spacer plate and said connector plate are movable relative to one another, rotatably, and along said slot to allow the distance between and the relative orientation of successive connector plates to be desirably configured;

successively positioned connector plates being rotatably coupled to one another by at least one of said spacer plates; and wherein to form a wall, a pair of connector plates is coupled via said retaining means, one to each of a pair of generally opposing ends defined by each structural member, said connector plates being rotatably movable relative to said spacer plates thereby allowing said structural members to be oriented relative to one another so as to form a surface having desired contours when a wall-forming material is fastened to, and extends between said structural members.

2. A system as defined by claim 1 wherein said at least two pairs of connector plates includes a plurality of connector plates and said at least two spacer plates includes a plurality of spacer plates.

3. A system as defined by claim 1 wherein each of said spacer plates defines adjustment means for selectively increasing or decreasing the distance between successive stud connector plates.

4. A system defined by claim 2 wherein:

at least two spacer plates are interposed between successive connector plates;

each spacer plate being rotatably coupled to one of said connector plates and slidably coupled to one another so that the distance between successive connector plates, as well as the orientation of successive connector plates relative to one another can be changed.

5. A system as defined by claim 4 wherein each of said spacer plates defines an elongated slot; and a fastener slidably extends through said slots defined by adjacent spacer plates thereby allowing the spacer plates to move relative to one another along said slots.

6. A system as defined by claim 1 further comprising a pair of structural straps that each extend between, and engage an outer surface defined by each of said connector plates, one of said structural straps being positioned adjacent to, and extending approximately perpendicular to, one distal end defined by said structural members, and the other of said structural straps being positioned adjacent to, and extending approximately perpendicular to, a generally opposing distal end defined by said structural members.

7. A system as defined by claim 1 wherein said retaining means includes a pocket defined in-part by substantially upstanding side walls, said pocket being configured to receive and retain a complimentarily shaped structural member.

8. A system as defined by claim 7 wherein at least a portion of said sidewalls define apertures extending there through each for receiving a fastener that extends through said aperture and into said structure member thereby attaching said structural member to said connector plate.

9. A system defined by claim 6 wherein said structural straps each define at least one aperture extending there through to allow said structural strap to, via a fastener, be coupled to an adjacent wall.

10. A system as defined by claim 6 further comprising a second pair of structural straps, said structural straps being positioned at and coupled to said distal ends of said structural members on opposing sides thereof.

11. A system as defined by claim 1 wherein each of said spacer plates defines means for creating an aperture therein for allowing conduit or wiring to extend there through.

12. A system defined by claim 11 wherein said means for creating an aperture includes a knockout portion retained on said spacer plate by at least one frangible portion.

13. A system as defined by claim 1 wherein at least one of said connector plates is an end plate.

* * * * *